US009943201B2

(12) United States Patent
Esposito et al.

(10) Patent No.: US 9,943,201 B2
(45) Date of Patent: Apr. 17, 2018

(54) FLOOR SUCTION DEVICE

(71) Applicant: BIG FOOT SUCTION, LLC, Atlanta, GA (US)

(72) Inventors: Nicholas A. Esposito, Smyrna, GA (US); Carol M. Wolfe, Smyrna, GA (US); Justin Pagano, Smyrna, GA (US); Keith Bright, Smyrna, GA (US)

(73) Assignee: BIG FOOT SUCTION, LLC, Atlanta, GA (US)

( * ) Notice: Subject to any disclaimer, the term of this patent is extended or adjusted under 35 U.S.C. 154(b) by 317 days.

(21) Appl. No.: 14/719,705

(22) Filed: May 22, 2015

(65) Prior Publication Data

US 2015/0342425 A1 Dec. 3, 2015

Related U.S. Application Data

(60) Provisional application No. 62/003,347, filed on May 27, 2014.

(51) Int. Cl.

| | |
|---|---|
| ***A47L 9/02*** | (2006.01) |
| ***A47L 7/00*** | (2006.01) |
| ***A47L 23/26*** | (2006.01) |
| ***A61G 13/10*** | (2006.01) |

(52) U.S. Cl.

CPC ..... *A47L 7/0004* (2013.01); *A47L 7/0009* (2013.01); *A47L 9/02* (2013.01); *A47L 23/266* (2013.01); *A61G 13/102* (2013.01)

(58) Field of Classification Search

CPC ..... A47L 7/0004; A47L 7/0009; A47L 9/02; A47L 23/266; A61G 13/102

USPC ..... 137/312

See application file for complete search history.

(56) References Cited

U.S. PATENT DOCUMENTS

| | | | | |
|---|---|---|---|---|
| 3,520,300 | A * | 7/1970 | Flower, Jr. | A61M 1/008 433/91 |
| 3,736,935 | A * | 6/1973 | Reimels | A61F 13/2082 604/362 |
| 4,515,594 | A * | 5/1985 | Pendergrass | A61F 13/36 602/44 |
| 5,032,184 | A | 7/1991 | Ogilvie et al. | |
| 5,720,078 | A | 2/1998 | Heintz | |
| 5,906,025 | A | 5/1999 | Johnson | |
| 6,136,098 | A | 10/2000 | Tribastone | |
| 6,706,027 | B2 * | 3/2004 | Harvie | A61F 5/453 604/319 |
| 6,938,639 | B1 * | 9/2005 | Robinson | A61G 13/102 128/849 |
| 7,207,977 | B2 | 4/2007 | Thompson et al. | |
| 7,290,558 | B2 | 11/2007 | DeChard et al. | |

(Continued)

OTHER PUBLICATIONS

Aspen Surgical, WaterBug Quiet Floor Suction Device; date unknown; 1 pg.

*Primary Examiner* — Bryan R Muller

(74) *Attorney, Agent, or Firm* — Gardner Groff Greenwald & Villanueva, PC

(57) ABSTRACT

A movable fluid collection device includes a mat assembly, a first conduit segment, and a second conduit segment. The mat assembly includes an absorption material and a low-friction sliding floor-contact material. The first conduit segment may include a loop of tubing having at least one fluid collection opening formed therein, and the second conduit segment connects the first conduit to a suction collection system.

12 Claims, 7 Drawing Sheets

(56) References Cited

U.S. PATENT DOCUMENTS

| | | | | |
|---|---|---|---|---|
| 8,801,685 | B2 * | 8/2014 | Armstrong | A61F 13/02 604/319 |
| 8,939,951 | B1 | 1/2015 | Getsay | |
| 9,265,913 | B2 * | 2/2016 | Fallin | A61M 1/008 |
| 9,451,854 | B2 | 9/2016 | Diminick et al. | |
| 2008/0091153 | A1 * | 4/2008 | Harvie | A61F 5/451 604/318 |
| 2008/0119802 | A1 * | 5/2008 | Riesinger | A61F 13/00068 604/313 |
| 2013/0344131 | A1 * | 12/2013 | Lo | A61L 15/18 424/447 |

* cited by examiner

FLOOR SUCTION DEVICE

CROSS-REFERENCE TO RELATED APPLICATIONS

This application claims the benefit of U.S. Provisional Patent Application Ser. No. 62/003,347 filed May 27, 2014, the entirety of which is hereby incorporated herein by reference for all purposes.

TECHNICAL FIELD

The present invention relates generally to the fields of medical and surgical equipment and fluid collection devices, and more particularly to a mobile suction device for removing liquids from a floor or other surface in hospital operating rooms, surgical suites, medical offices and/or other environments.

BACKGROUND

During surgery or other medical procedures it is common for fluids to collect on the floor and or other surfaces of an operating room, surgical suite, medical or dental office or other areas. Often, towels, blankets, surgical matting or other absorbent materials may be used to collect the fluid. Collecting surgical fluids by hand can be messy, and potentially exposes personnel to contaminants. Alternatively, a suction disc may be provided to collect fluid from the floor surface. But suction discs may be expensive, require additional cleaning and maintenance after use, and typically are stationary on the floor surface. Accordingly, it can be seen that needs exist for an improved surgical floor suction device. It is to the provision of a surgical floor suction device meeting these and other needs that the present invention is primarily directed.

SUMMARY

In example forms, the present invention provides a portable and disposable surgical floor suction device for absorbing and removing unwanted fluids from a floor surface. In representative embodiments, the invention provides a movable, renewable and durable suction and absorption apparatus dedicated to sucking and absorbing fluids off of the floor during and after surgical cases. It is easily repositioned with the use of a person's foot. The movability, renewability, and multi-functional capabilities of the product's utility and design provide significant advantage over previously known methods and equipment.

In one aspect, the present invention relates to a surgical floor suction device including a movable absorptive mat assembly, a first conduit, and a second conduit. The mat assembly includes an absorption material and a sliding netting material. The first conduit includes a loop of tubing having at least one fluid collection opening formed therein and a Y-connector. The second conduit is provided for connection between the Y-connector of the first conduit and a suction system.

In another aspect, the invention relates to a surgical floor suction device including a mat assembly having a pocket, a first conduit segment for fitting within the pocket, and a second conduit segment having a first end attached to or extending from the first conduit segment and a second end for removably coupling to a suction device.

In still another aspect, the invention relates to a movable surgical floor suction device for collecting fluids from a floor surface including a mat assembly, and at least one suction conduit. The mat assembly includes an absorption material layer and a screen material layer. The screen material layer is affixed to a bottom portion of the absorption material and configured for low-friction sliding along the floor surface, and wherein affixing the screen material layer to the absorption material layer defines a pocket. At least a portion of the suction conduit is positioned within the pocket and includes a length of tubing having at least one opening formed therein for suctioning fluid from the mat assembly, and a distal end for coupling to a suction device. Preferably, the device is configured such that a human user's foot or shoe sole can be placed atop the mat assembly to move the mat assembly across the floor surface to collect unwanted fluids therefrom.

In yet another aspect, the present invention relates to a method of removing unwanted fluids from a floor surface. The method includes providing a surgical floor suction device, the surgical floor suction device including a mat assembly, a first conduit and a second conduit, the mat assembly including an absorption material and a netting material, the netting material being affixed to a bottom portion thereof; placing the surgical floor suction device on the floor surface wherein the netting material is in contact with the floor surface; placing a foot atop the mat assembly; and moving the mat assembly across the floor surface by movement of the foot to collect the unwanted fluids.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
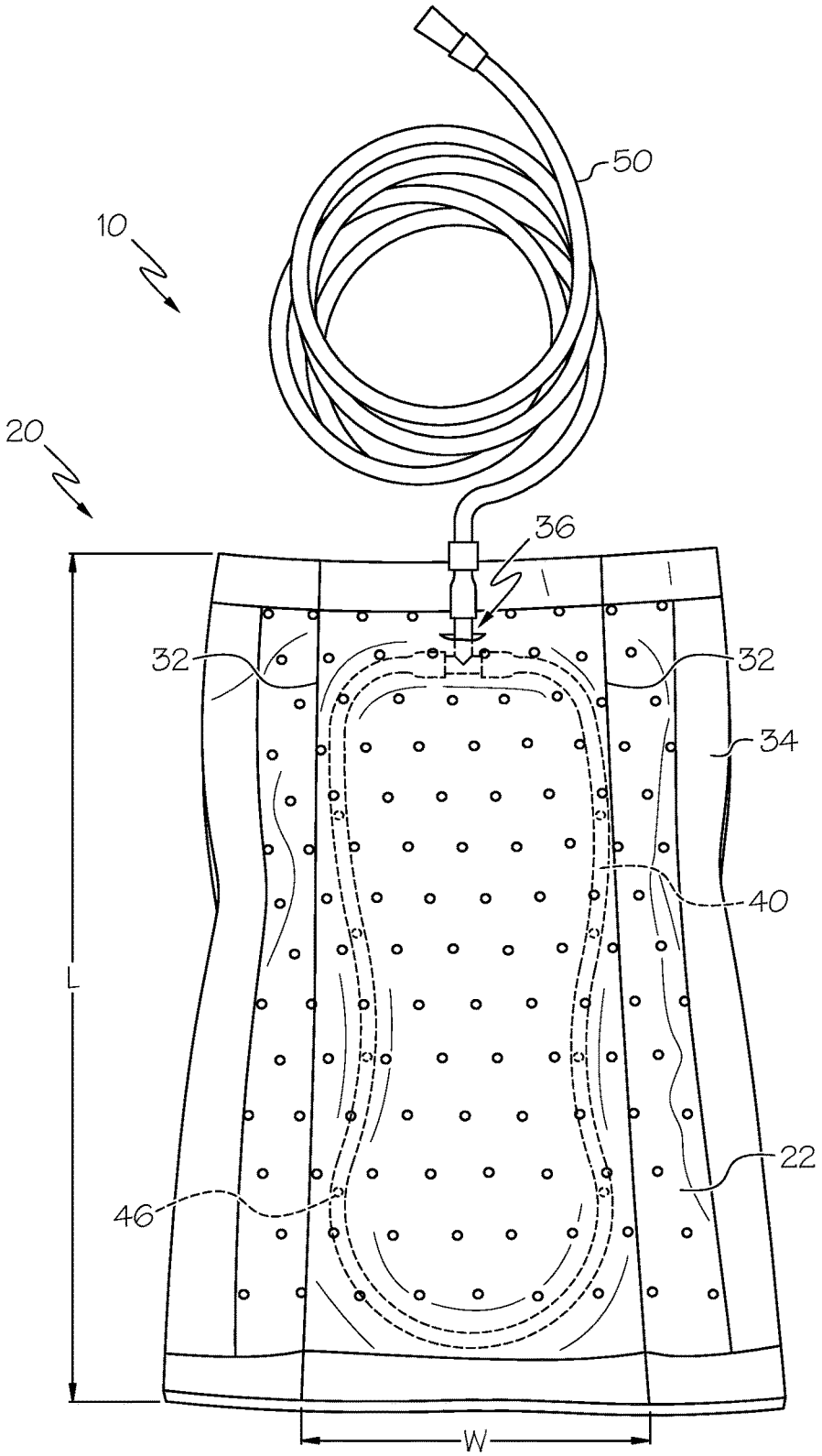
FIG. 1 is a top view of a surgical floor suction device according to an example embodiment of the present invention.

With reference now to the drawing figures, wherein like reference numbers represent corresponding parts throughout the several views, FIG. 1 shows a floor suction device 10 according to an example embodiment of the present invention. As depicted, the device 10 generally comprises a mat assembly 20, a first conduit 40, and a second conduit 50. The first conduit 40 is generally contained within the mat assembly 20, and the second conduit 50 is connected to a suction device such as a surgical suction pump, and communicates with the first conduit 40. In alternate embodiments, the first and second conduits form segments of a single continuous and unitary length of conduit, with a first segment of the conduit within the mat assembly and a second segment of the conduit extending outside of the mat assembly. Preferably, the floor suction device 10 is capable of removing unwanted fluid from a floor surface by wicking and absorption of the fluid into the mat assembly 20 and sucking the fluid from the mat assembly into the first conduit 40 and out through the second conduit for collection and disposal by a suction device. Preferably, the floor suction device 10 is capable of being moved on the floor surface by a user's foot, for example wherein the foot or shoe sole is to be placed generally on the top surface of the mat assembly 20. Alternately, the floor suction device 10 can remain stationary on the floor surface.

Figure 2:
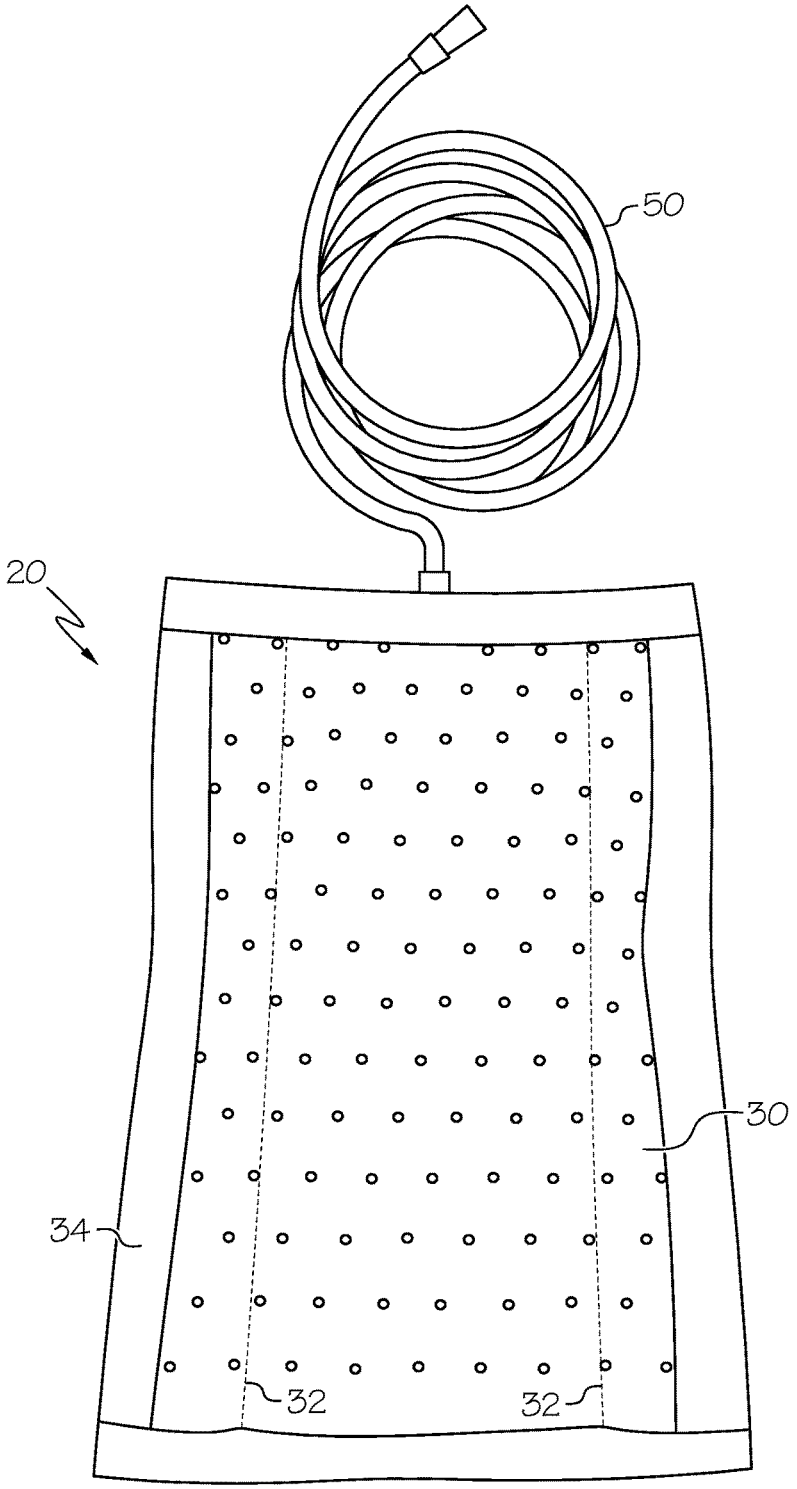
FIG. 2 is a bottom view of the surgical floor suction device of FIG. 1.

As depicted in FIGS. 1-2, the mat assembly 20 is generally rectangular in shape and is formed from an absorption mat 22 and a screen-like mesh or netting material 30. Optionally, the mat assembly 20 can be shaped as desired, for example, circular, polygonal, oval, etc. In one form, the mat assembly 20 is constructed such that the netting material 30 is coupled to at least a portion of the bottom of the absorption mat 22, which can be affixed thereto by stitching, adhesives, tape, heat bonding, etc. The mesh 30 may comprise a natural or synthetic rubber, plastic or other material (s), and is preferably non-absorbent and provides a low coefficient of friction for sliding along common flooring surfaces. Preferably, the absorption mat 22 comprises two or more sheets of matting material having a high absorbency and wicking properties, which are generally aligned along their edges and affixed together. Alternately, the absorption mat 22 may comprise a single sheet of matting material that is generally folded to form two layered sheets.

In example forms, laterally offset stitches 32 are provided along the length of the mat assembly 20 to affix the two sheets of matting material together and to affix the absorption mat 22 to the netting material 30. By affixing the matting material of the mat 22 and the netting material 30 together by stitches 32, a generally centrally positioned pocket, slot, or reservoir is formed within the mat 22 (e.g., between the two sheets of matting material) to contain the first conduit 40 therein. In one example form, the pocket comprises a length L and width W, which are configured to provide an area wherein a user's foot or shoe sole can be placed thereon (e.g., the foot being placed on a top portion of the mat assembly), for example to move the device 10 on the floor surface to proactively remove fluid therefrom (as will be described below). Optionally, indicia can be provided on the pocket to indicate placement and position of the user's foot. Further optionally, one or more side edges of the assembly 20 can comprise affixing means 34 for additional support of the mat assembly 20, which may include gaffe tape, additional stitching, glue, adhesive, heat bonding, etc.

Figure 3:
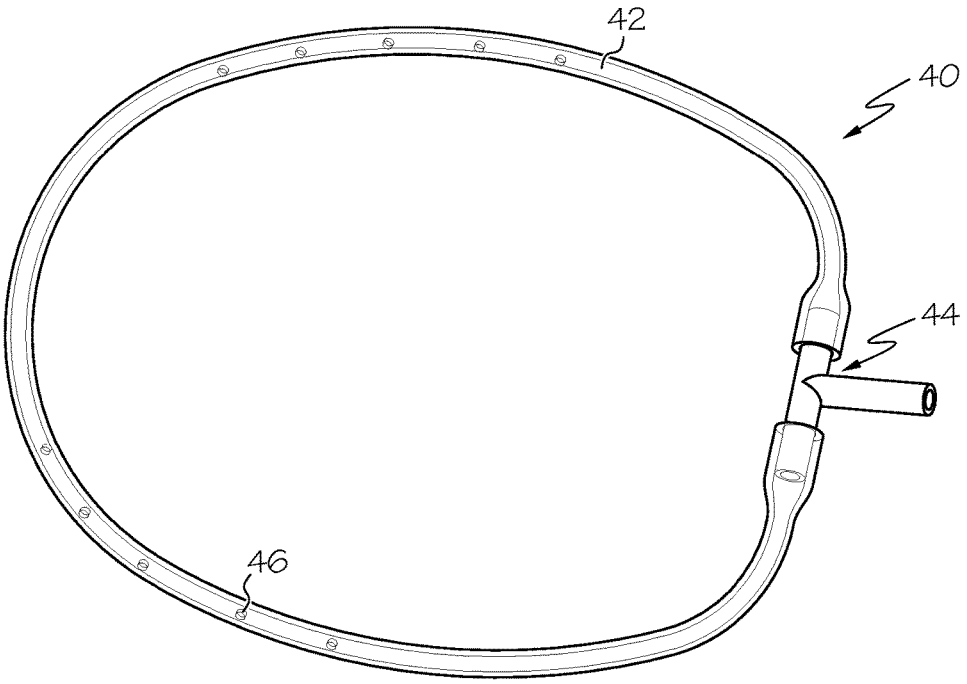
FIG. 3 is a perspective view of a first conduit segment of the surgical floor suction device of FIG. 1.

FIG. 3 shows the first conduit 40 in greater detail. Generally, the first conduit 40 comprises a length of tubing 42, a Y-shaped or T-shaped coupling or connector 44, and a plurality of openings 46 formed in the tubing 42. Preferably, the ends of the tubing 42 are connected to first and second oppositely opposed ends of the Y-shaped or T-shaped connector 44 to generally form a loop, and a third end of the connector 44 (generally extending perpendicular from the oppositely opposed ends) is further connected to an end fitting of the second conduit 50. In example forms, the tubing 42 is generally shaped to form a generally oval or elliptical loop corresponding to the shape of a human foot or shoe sole. In one form, the tubing is shaped and sized to adequately fit within the pocket of the mat assembly 20 and provide an area therein that is generally sized and shaped to receive the foot or shoe sole within or over the loop of tubing. Preferably, a slot or opening 36 is provided in an upper portion of the absorption mat 22 (allowing access to the pocket) such that the third end of the connector 44 can extend therethrough to be connected with the proximal end of the second conduit 50. The distal end of the second conduit 50 similarly comprises an end fitting to be connected to an external suction device such as a suction pump or blower and suction canister fluid collection system.

Figure 4:
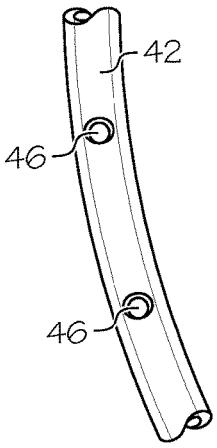
FIG. 4 is a detailed view of a portion of the first conduit of FIG. 3, showing a portion thereof comprising a plurality of openings.

FIG. 4 shows a portion of the first conduit 40 in greater detail. Preferably, a plurality of openings 46 are spaced along the length of the tubing 42 such that fluid wicked by the mat 22 is drawn into the first conduit 40 and then suctioned out the second conduit 50 towards the suction device. In one form, the plurality of openings are provided along the lengthwise sides of the tubing, for example wherein about 5 openings 46 are provided along each side of the tubing 42 (see FIG. 1). In another form, the tubing 42 can comprise about 10 openings 46 along each side of the tubing 42 (e.g., total of about 20 openings). Optionally, fewer or more openings are provided along the tubing 42.

In use, the floor suction device 10 preferably provides a method for the removal of unwanted fluid from a floor surface. In example forms, the floor suction device 10 is preferably placed on the floor surface with the netting material 30 facing down and in contact with the floor surface in the area of fluid to be collected. A user's foot is then placed atop the centrally positioned pocket of the mat assembly 20 (and within the loop of first conduit 40, see foot image) to allow the user to move the mat assembly 20 across the floor surface. As the mat assembly 20 begins to contact the fluid, the fluid is wicked into the mat 22 and drawn under suction into the first conduit 40. The fluid is subsequently drawn under suction from the first conduit 40 into the second conduit 50 and towards the suction device. Preferably, the netting material 30 in contact with the floor surface allows the assembly 20 to move smoothly and without excess friction across the floor surface. Thus, despite any quantity of fluid being wicked within the absorption mat 22, the mat assembly 20 is preferably capable of freely sliding on the floor surface by providing the netting material 30 on the bottom surface of the mat assembly 20.

In example embodiments, the absorption mat 22 comprises one or more sheets of woven or non-woven surgical absorption matting that is generally sized to be about 10"×30", which is folded in half such that the overall size is about 10"×15". The netting material is formed from a rubber mesh-like screen that is generally sized to be about 10"×15". Thus, in example forms, the mat assembly is generally rectangular-shaped and about 10"×15". The pocket is generally sized to have a length L of about 15" and a width W of about 6". The first conduit 40 generally comprises a ¼" or ⅜" surgical vinyl tubing having a length of about 30". Preferably, the openings 46 are generally circular and are sized to have a diameter of about 1/16". The Y-shaped connector generally comprises three ribbed ends that all are sized to removably engage tubing having a diameter of about ⅜". The second conduit 50 generally comprises about 10' of ¼" or 3/16" suction tubing such as for example Medline sterile suction tubing. One or both ends of the second conduit 50 optionally comprise adaptor fittings to provide for connecting to the Y-shaped connector 44 and the suction device. The optional affixing means 34 can include gaffing tape having a width between about 1"-2". The thread for forming the stitches 32 can be in the form of heavy duty polyester or other material. A footprint image, instructions, safety warnings, or other images, indicia or material may optionally be printed, painted, embossed, dyed, or otherwise applied to the mat 22. Optionally, additional/other glues, adhesives, dyes, paints, fabrics, tubes, connectors, etc. may be incorporated with the floor suction device 10 as desired. Preferably, the dimensions and specifications as recited herein are according to one example form of the present invention. Optionally, the dimensions, specifications, shapes, components, etc. as recited herein can be chosen as desired. For example, in additional example embodiments, the absorption mat 22 can be sized as desired. In one form, the mat 22 is sized to be about 20"×30" (e.g., about double the area of the 10"×15" mat), and in another form, the mat 22 is sized to be about 5"×7.5" (e.g., about half the area of the 10"×15" mat). In other example forms, the mat 22 can be about 10"×15", about 15"×20", about 10"×30", or other sizes as desired. Preferably, the other components to be assembled with the absorption mat 22 (e.g., netting material, etc.) are sized accordingly. Furthermore, as described above, the quantity of openings 46 formed in the tubing 42 can be changed according to the size of the mat 22. In typical embodiments, the tubing 42 of the 10"×15" mat comprises about 10 openings 46, the tubing 42 of the 20"×30" mat comprises about 20 openings 46, and the tubing 42 of the 5"×7.5" mat comprises about 10 openings 46.

Figure 5:
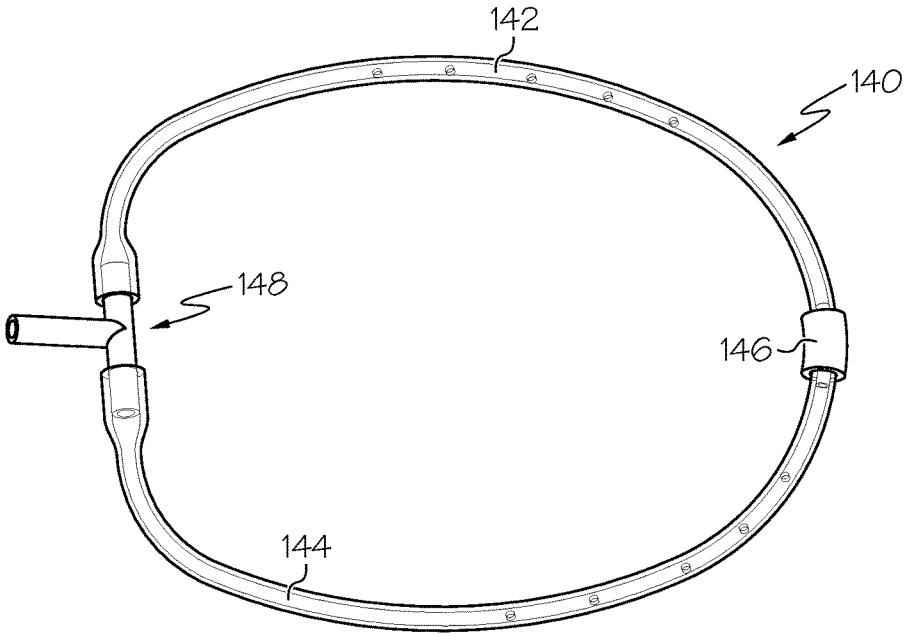
FIG. 5 shows the internal conduit segment arrangement of another embodiment of a floor suction device according to an example form of the invention.
Figure 6:
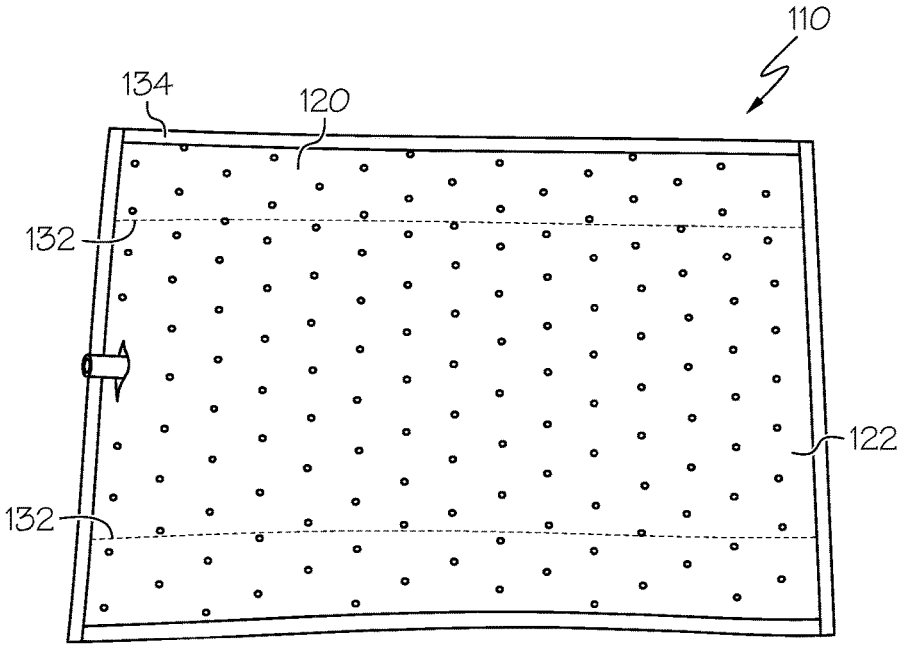
FIG. 6 shows a top view of another embodiment of a floor suction device according to an example form of the invention.
Figure 7:
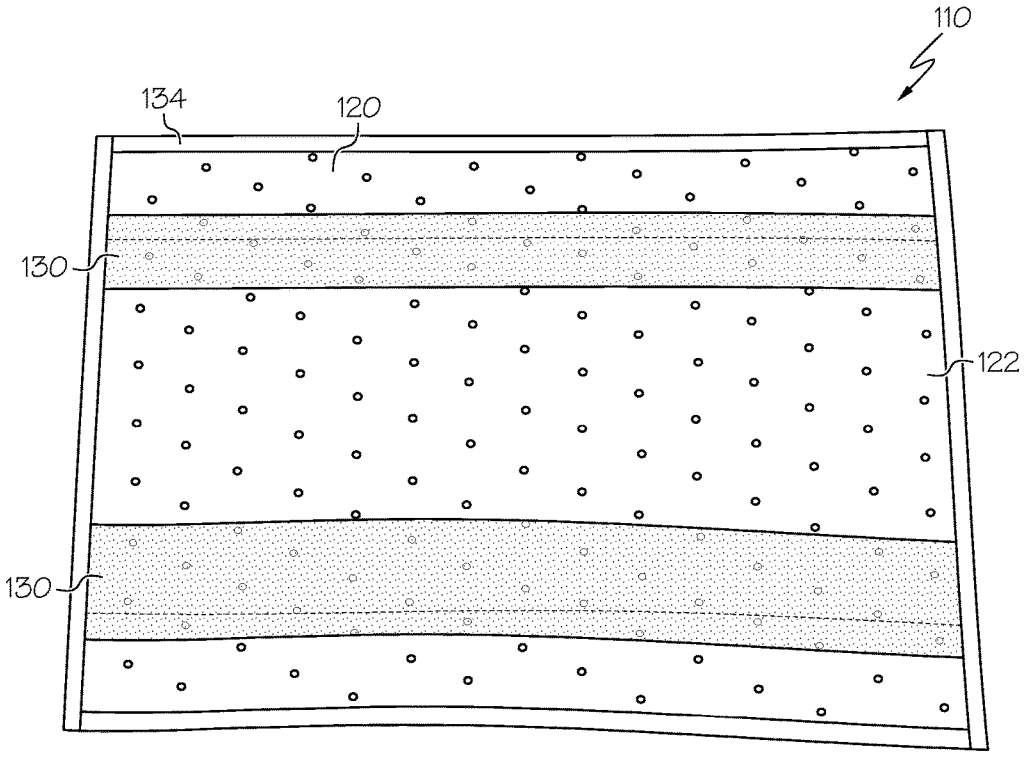
FIG. 7 shows a bottom view of another embodiment of a floor suction device according to an example form of the invention.

FIGS. 5-7 show another example embodiment of a floor suction device 110 according to the present invention. As depicted, the device 110 generally comprises a mat assembly 120, a first conduit segment 140, and a second conduit segment. The first conduit segment 140 comprises a loop of tubing defining a first section 142 and a second section 144, having a fluid-impermeable plug 146 at opposite the Y-coupling 148, segregating the loop into separate suction sections. One or more fluid suction holes are spaced along each of the sections 142, 144. For example in the depicted embodiment, five suction holes are spaced along each of the sections. The mesh 130 is applied in one or more strips to the bottom of the mat 120, for example extending lengthwise along the mat, covering a portion of the bottom of the mat and leaving a portion of the absorbent material 122 exposed along the bottom of the mat for contact with the floor. Seams 132 retain the mesh in place on the mat and define the pocket within which the first conduit segment 140 is positioned, with the foot applied generally centrally within the loop of the first conduit segment. One inch (1") gaff tape 134 is applied in a border around the edges.

In an additional embodiment, one or more suction devices can be packaged in a kit. One example kit includes two suction devices, at least one length of second conduit tubing, and instructions for use, packaged within a poly bag or other packaging. In a further embodiment, the mat assembly, the first conduit, or both are disposable and/or replaceable.

Figure 8:
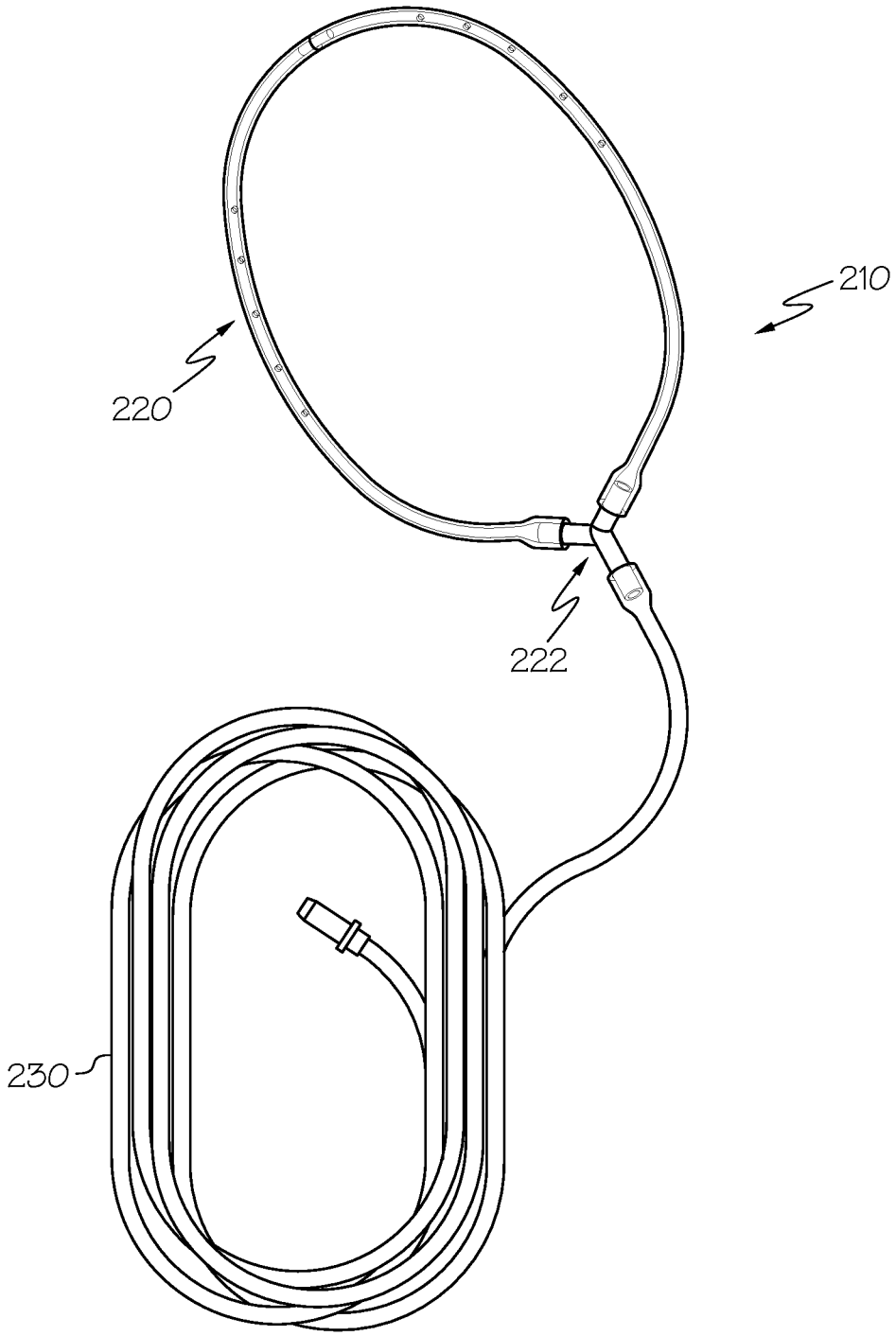
FIG. 8 shows a hose-only embodiment of a floor suction device according to an example form of the invention.

FIG. 8 shows another example embodiment of a floor suction device 210 according to the present invention. As depicted, the device 210 generally comprises a first conduit segment 220 and a second conduit segment 230. The first conduit 220 can operate as a hose-only suction device without an absorbent mat and the second conduit 230 is connected to a suction device such as a surgical suction pump, and communicates with the first conduit 220. In this embodiment, the first conduit 220 and the second conduit 230 are lengths of flexible tubing joined by a T- or Y-coupling 222 with the first conduit segment forming a loop having a plurality of suction openings spaced along its length in similar fashion to that described above. In alternate embodiments, the first and second conduits form segments of a single continuous and unitary length of conduit, with a first segment of the conduit laid on the floor in the area of a possible spill and a second segment of the conduit extending away from the possible spill area. Preferably, the floor suction device 210 is capable of removing unwanted fluid from a floor surface by suction of the fluid from the floor into the first conduit 220 and out through the second conduit 230 for collection and disposal by a suction device. Preferably, the floor suction device 210 is capable of being moved on the floor surface by a user's foot. Alternately, the floor suction device 210 can remain stationary on the floor surface. In alternate embodiments, the hose-only suction device 210 may be provided in combination with a removable absorbent mat similar to the above-described embodiments, such that a user can selectively install or remove the mat and use the device as a hose-only device or a hose-and-mat device.

Figure 9:
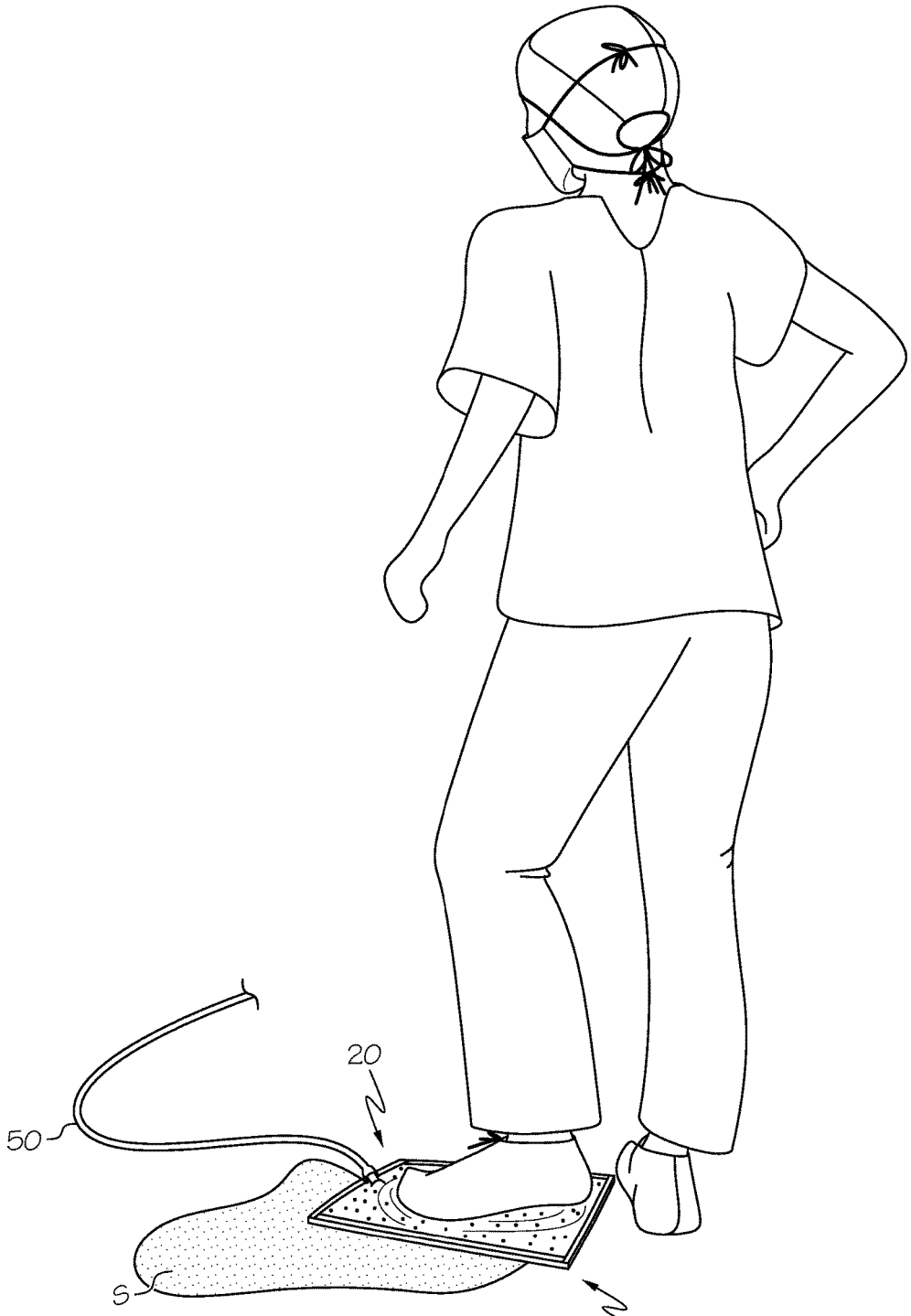
FIG. 9 shows a person using a floor suction device to clean up a fluid spill in accordance with an embodiment of the present invention.

In additional example embodiments, the present invention comprises a method of removing fluids from a floor surface. The method preferably includes providing an absorbent suction device comprising a mat assembly, a first conduit segment and a second conduit segment, the mat assembly comprising an absorption material and a free-sliding mesh material, the mesh material being affixed to a bottom portion of the mat; placing the floor suction device on the floor surface wherein the netting material is in contact with the floor surface; placing a foot atop the mat assembly; and moving the mat assembly across the floor surface by movement of the foot to collect the fluids. FIG. 9 shows an exemplary embodiment of the present invention in which a person removes a fluid or spill S from a surface using the floor suction device 10 by placing the mat assembly 20 on a surface and moving the mat with one foot while second conduit 50 carries the fluid or spill away from the surface.

While the invention has been described with reference to preferred and example embodiments, it will be understood by those skilled in the art that a variety of modifications, additions and deletions are within the scope of the invention, as defined by the following claims.

What is claimed is:

1. A floor suction device comprising:

a mat assembly comprising a top portion defining a foot engagement area configured for engagement with a user's foot, and a bottom portion comprising an absorbent material and one or more strips of a low-friction sliding mesh material applied over only a covered portion of the absorbent material, leaving an uncovered portion of the absorbent material exposed and without the strips of low-friction sliding mesh material being applied over the uncovered portion, the bottom portion of the mat being configured for freely sliding along a floor surface by movement of the user's foot applied against the foot engagement area of the top portion of the mat assembly, the bottom portion of the mat assembly allowing passage therethrough of a fluid disposed on the floor surface;

a first suction delivery conduit positioned between the top portion and the bottom portion of the mat assembly, the first suction delivery conduit having a plurality of openings formed therein, said openings being spaced about and generally beneath the foot engagement area of the top portion of the mat assembly and configured for drawing in the fluid passing through the bottom portion of the mat assembly from the floor surface under applied suction; and a second suction delivery conduit extending from the first suction delivery conduit, the second suction delivery conduit segment configured for connection to a suction pump to apply suction to the first suction delivery conduit.

2. The floor suction device of claim 1, wherein the first suction delivery conduit segment comprises a loop of tubing having the plurality of openings spaced along the loop, the loop of tubing being configured to receive the user's foot within or over the loop of tubing and thereby define the foot engagement area of the mat assembly.

3. The floor suction device of claim 1, wherein the low-friction sliding mesh material is attached to the bottom of the absorption material by stitching, an adhesive, tape, or heat bonding.

4. The floor suction device of claim 1, wherein the low-friction sliding mesh material comprises a plastic or a natural or synthetic rubber.

5. The floor suction device of claim 1, wherein the mat assembly comprises two or more sheets of absorption material.

6. The floor suction device of claim 1, wherein the mat assembly comprises a single sheet of absorption material that is folded to form two layered sheets.

7. The floor suction device of claim 1, wherein a pocket is defined within the mat assembly for receiving the first suction delivery conduit.

8. The floor suction device of claim 7, wherein the mat assembly comprises a slot or opening allowing access to the pocket.

9. The floor suction device of claim 1, further comprising affixing means for additional support of the mat assembly.

10. The floor suction device of claim 9, wherein the affixing means comprises gaffe tape, stitching, glue, adhesive, or heat bonding.

11. A movable surgical floor suction device for removing fluids from a floor surface comprising:

a mat assembly comprising a top portion defining a foot engagement area configured for engagement with a user's foot, and a bottom portion comprising a fluid absorbent material and one or more strips of a low-friction sliding mesh material applied over only a covered portion of the absorbent material, leaving an uncovered portion of the absorbent material exposed and without the strips of low-friction sliding mesh material being applied over the uncovered portion, the bottom portion of the mat being configured for allowing the device to move in free sliding engagement along the floor surface by movement of the user's foot applied against the foot engagement area of the top portion of the mat assembly, and wherein a pocket is defined within the mat assembly between the top portion and the bottom portion;

a first suction delivery conduit positioned within the pocket between the top portion and the bottom portion of the mat assembly, the first suction delivery conduit having a plurality of openings formed therein, said openings being spaced about and generally beneath the foot engagement area of the top portion of the mat assembly and configured for drawing in fluid from the bottom portion of the mat assembly under applied suction; and a second suction delivery conduit comprising a first end and a second end, the first end for coupling to the first suction delivery conduit and the second end for coupling to a suction device.

12. The movable surgical floor suction device of claim 11 wherein the first suction delivery conduit comprises a loop of tubing having the plurality of openings spaced along the loop.

* * * * *